US005419012A

United States Patent [19]

Lewis

[11] Patent Number: 5,419,012

[45] Date of Patent: May 30, 1995

[54] GOOSENECK HINGE FOR VEHICLE DECK LID

[75] Inventor: Cecil H. Lewis, Monroe, Mich.

[73] Assignee: Midway Products Group, Inc., Monroe, Mich.

[21] Appl. No.: 250,444

[22] Filed: May 27, 1994

[51] Int. Cl.[6] ..... E05D 7/04

[52] U.S. Cl. ..... 16/306; 16/367; 296/76

[58] Field of Search ..... 16/306, 367; 296/76

[56] References Cited

U.S. PATENT DOCUMENTS

| | | | |
|---|---|---|---|
| 1,887,549 | 11/1932 | Ervin . | |
| 2,071,070 | 2/1937 | Horst . | |
| 2,085,616 | 6/1937 | Voge . | |
| 3,304,117 | 2/1967 | Harris et al. . | |
| 4,206,944 | 6/1980 | Kumagai et al. | 296/76 |
| 4,692,964 | 9/1987 | DeBruyn | 16/367 |
| 5,195,215 | 3/1993 | Kiefer | 16/387 |
| 5,195,796 | 3/1993 | Wampler, II | 296/76 |
| 5,365,639 | 11/1994 | Lewkoski | 16/224 |

*Primary Examiner*—Mark Rosenbaum
*Assistant Examiner*—Kenneth J. Hansen
*Attorney, Agent, or Firm*—Brooks & Kushman

[57] ABSTRACT

A gooseneck type hinge (18) for a vehicle body deck lid (16) includes a gooseneck member (20) moved by a control link (42) between a vertically extending orientation in an open position of the deck lid and a horizontally extending orientation in a closed position of the a deck lid so as to limit the extent to which the gooseneck member (20) of the hinge intrudes into the usable space of the associated vehicle body compartment (12). A universal hinge member (30) of the hinge has a first pivotal connection (32) for providing pivoting thereof about a first axis A on a vehicle body mounted member (28) and also has a second pivotal connection (34) that mounts a first end (22) of the gooseneck member (20) with respect thereto about a second axis B that is generally transverse to the first axis A. A deck lid member (36) of the hinge is fixed to the deck lid (16) and has a pivotal connection (40) for providing pivotal mounting of a second end (24) of the gooseneck member (20) in order to permit the swinging movement of the gooseneck member under the operation of the control link (42). A counterbalance spring (46) that is preferably of the spiral type extends between the body member (28) and the universal hinge member (30) of the hinge to counterbalance the weight of the deck lid (16) in the open position.

12 Claims, 3 Drawing Sheets

GOOSENECK HINGE FOR VEHICLE DECK LID

TECHNICAL FIELD

This invention relates to a gooseneck hinge for mounting a deck lid on a vehicle body for movement between open and closed positions with respect to an access opening of a compartment of the vehicle body.

BACKGROUND ART

Vehicle body deck lids are conventionally mounted by gooseneck hinges for movement between open and closed positions with respect to an access opening of a compartment of the vehicle body. Such gooseneck hinges as disclosed by U.S. Pat. Nos.: 3,304,117 Harris et al and 5,195,215 Kiefer conventionally have a gooseneck member with one end pivotally mounted on the vehicle body and another end fixedly secured to the deck lid and with a curved intermediate portion extending between the ends such that the deck lid edge is capable of moving away from the vehicle body in a spaced relationship upon movement from a closed position to an open position. Other gooseneck hinges such as disclosed by U.S. Pat. Nos.: 4,206,944 Kumagai et al and 5,195,796 Wampler, II have previously had the gooseneck member provided with an end slidably mounted on the vehicle body such as in a straight or curved slot. Regardless of the manner in which the gooseneck hinge is mounted either by pivoting or sliding, in the closed position the curved shape of the gooseneck member intrudes into the associated vehicle compartment and thereby limits it usable space.

Other patents which were noted during an investigation conducted in connection with the present invention but which do not relate to vehicle deck lid hinges and are thus not believed to be as relevant as the patents described above include U.S. Pat. Nos.: 1,887,549 Ervin; 2,071,070 Horst; 2,085,616 Voge; and 4,692,964 Debruyn.

DISCLOSURE OF INVENTION

An object of the present invention is to provide an improved gooseneck hinge that has a reduced extent of protrusion of the hinge into the associated vehicle body compartment with the deck lid in the closed position.

In carrying out the above object, the invention provides a gooseneck hinge for mounting a deck lid on a vehicle body for movement between open and closed positions with respect to an access opening of a compartment of the vehicle body. This hinge includes a gooseneck member having first and second ends and a curved intermediate portion extending between its ends. A body member of the hinge is fixedly mountable on the vehicle body. A universal hinge member of the hinge has a first pivotal connection for mounting thereof on the body member for pivotal movement about a first axis. The universal hinge member also has a second pivotal connection that mounts the first end of the gooseneck member for pivotal movement with respect thereto about a second axis generally transverse to the first axis. A deck lid member of the hinge is fixedly mountable on the deck lid and has a pivotal connection for mounting the second end of the gooseneck member for pivotal movement with respect thereto about the second axis. A control link of the hinge extends between the intermediate portion of the gooseneck member and a fixed location on the vehicle body to swing the curved intermediate portion of the gooseneck member between a vertical orientation with the deck lid in the open position and a horizontal orientation with the deck lid in the closed position to thereby limit the extent to which the gooseneck member intrudes into the usable space of the compartment of the vehicle body.

In the preferred construction, the first axis about which the universal hinge member pivots about the body member is spaced from the second axis about which the gooseneck member pivots with respect to the universal hinge member and the deck lid.

The preferred construction of the gooseneck hinge also includes a counterbalance spring that extends between the body member and the universal hinge member to counterbalance the weight of the deck lid in the open position. This counterbalance spring is most preferably of the spiral type having an inner end secured to the body member and an outer end secured to the universal hinge member.

As preferably constructed, the gooseneck hinge has a body member provided with horizontally spaced portions between which the first pivotal connection of the universal hinge member provides mounting thereof on the body member for the pivotal movement about the first axis. The universal hinge member preferably has a pair of spaced portions secured to each other. Furthermore, the spiral type counterbalance spring is preferably located on the opposite side of one of the spaced portions of the body member as the universal hinge member that is located between the spaced portions of the body member. This one spaced portion of the body member has a first projection that extends horizontally to the counterbalance spring which has its inner end secured to the first projection. Furthermore, the universal hinge member has a second projection that extends horizontally to the counterbalance spring which also has its outer end secured to the second projection so as to counterbalance the weight of the deck lid in the open position.

In the preferred construction disclosed, the control link has one end including a ball joint for providing securement thereof to the intermediate portion of the gooseneck member and also has another end including another ball joint for providing securement thereof to the fixed location on the vehicle body. The control link, in addition to preferably having the ball joints for providing the securement of its ends to the intermediate portion of the gooseneck member and the fixed location on the body portion, also can be constructed to include a length adjuster to control the extent to which the gooseneck member swings upon movement of the deck lid between the open and closed positions.

The objects, features and advantages of the present invention are readily apparent from the following detailed description of the best modes for carrying out the invention when taken in connection with the accompanying drawings.

BEST MODES FOR CARRYING OUT THE INVENTION

Figure 1:
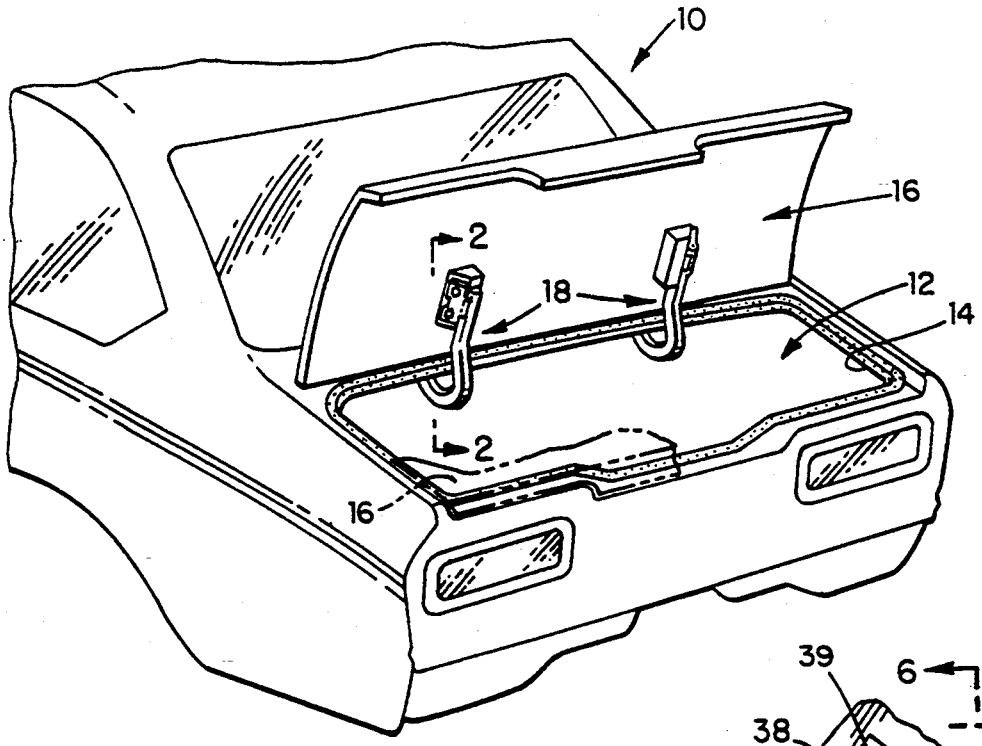
FIG. 1 is a partial perspective view of a vehicle body having gooseneck hinges that are constructed in accordance with the present invention to support a deck lid for movement between open and closed positions with respect to an access opening of a compartment of the vehicle body.

With reference to FIG. 1 of the drawings, a vehicle body 10 is illustrated as having a rear storage compartment 12 with an access opening 14 that is opened and closed by a deck lid 16. A pair of gooseneck hinges 18 that are each constructed in accordance with the present invention mount the deck lid 16 for movement with respect to the compartment access opening 14 between the open position shown fully by solid line representation and the closed position shown partially by phantom line representation.

Figure 2:
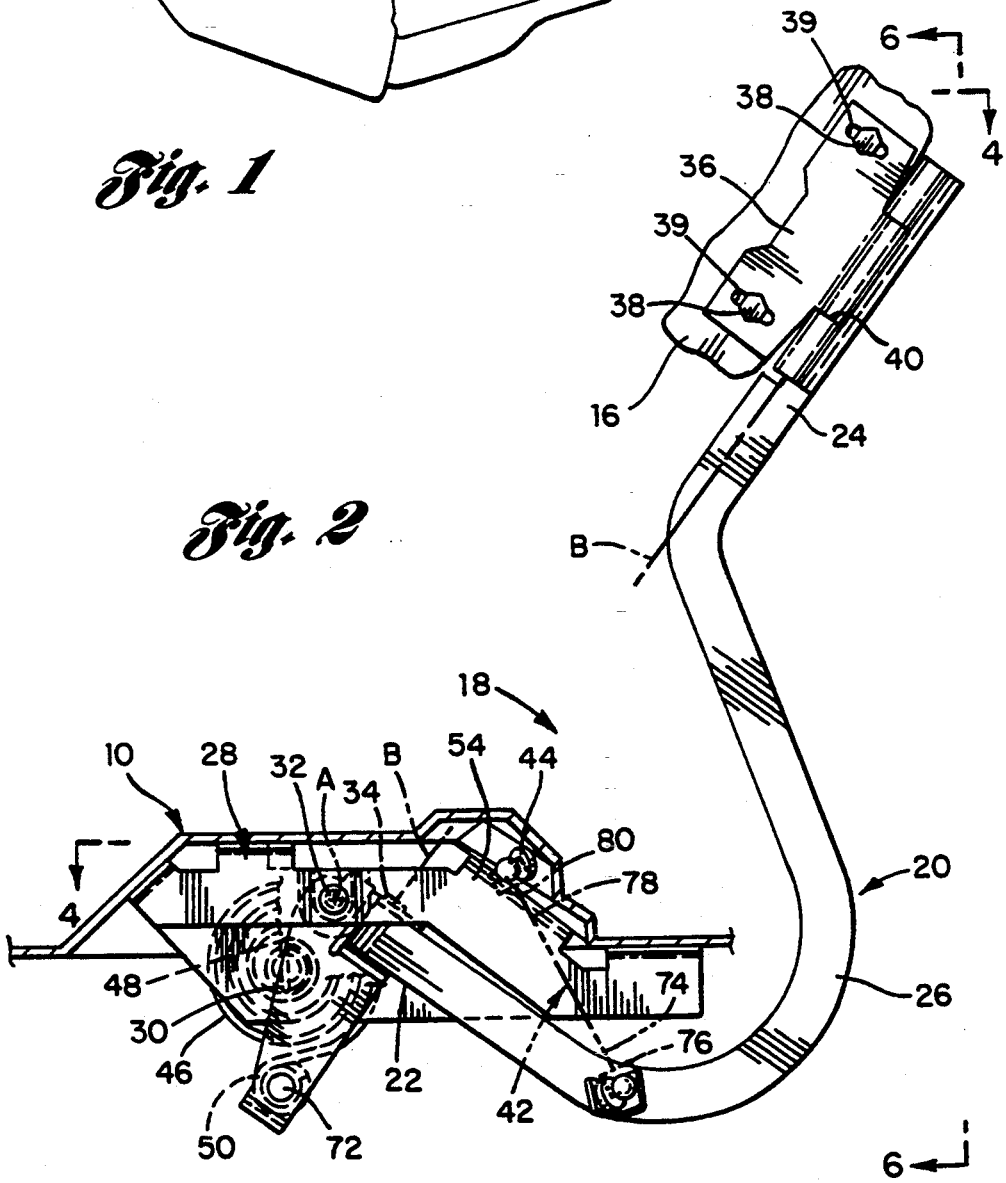
FIG. 2 is a side elevational view of the gooseneck hinge taken along the direction of line 2—2 in FIG. 1 and illustrates the hinge in the open position.
Figure 4:
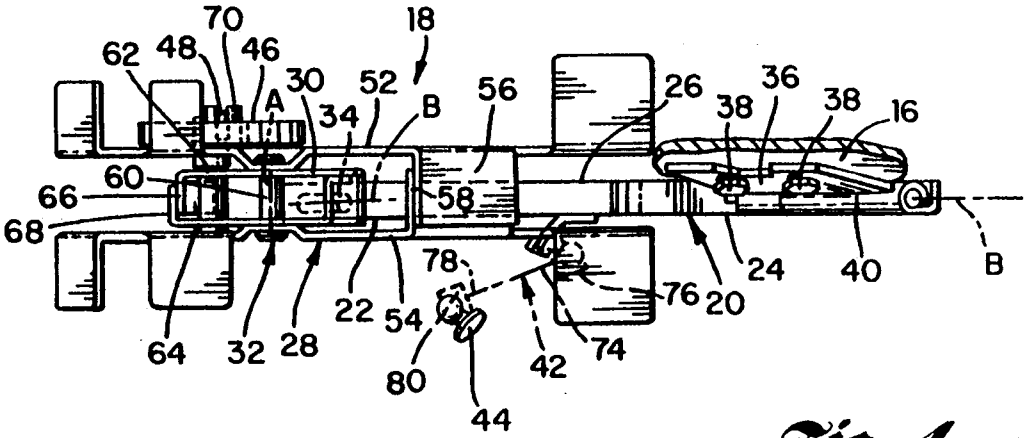
FIG. 4 is a top plan view of the gooseneck hinge taken along the direction of line 4—4 in FIG. 2 where the hinge is in the open position.

With additional reference to FIG. 2, each gooseneck hinge 18 includes a gooseneck member 20 having first and second ends 22 and 24 as well as having a curved intermediate portion 26 extending between its ends. A body member 28 of the hinge is fixedly mounted on the vehicle body 10 in any suitable manner such as by welding or fasteners. When fasteners are utilized, slots may also be provided to permit adjustment for proper positioning. A universal hinge member 30 of the hinge has a first pivotal connection 32 for mounting this hinge member on the body member 28 for pivotal movement about a first axis A. The universal hinge member 30 also has a second pivotal connection 34 (FIGS. 2 and 4) that mounts the first end 22 of the gooseneck member 20 for pivotal movement with respect thereto about a second axis B that is generally transverse to the first axis A. A deck lid member 36 of the hinge 18 is mountable in any suitable manner on the deck lid 16 such as by the threaded fasteners 38 shown. Slots 39 shown in FIGS. 2 and 4 permit adjustment prior to tightening of the fasteners so as to provide proper positioning. A pivotal connection 40 of deck lid member 36 mounts the second end 24 of the gooseneck member 20 for pivotal movement with respect to the deck lid about the second axis B so as to be in alignment with the axis of pivoting of the pivotal connection 34.

Figure 3:
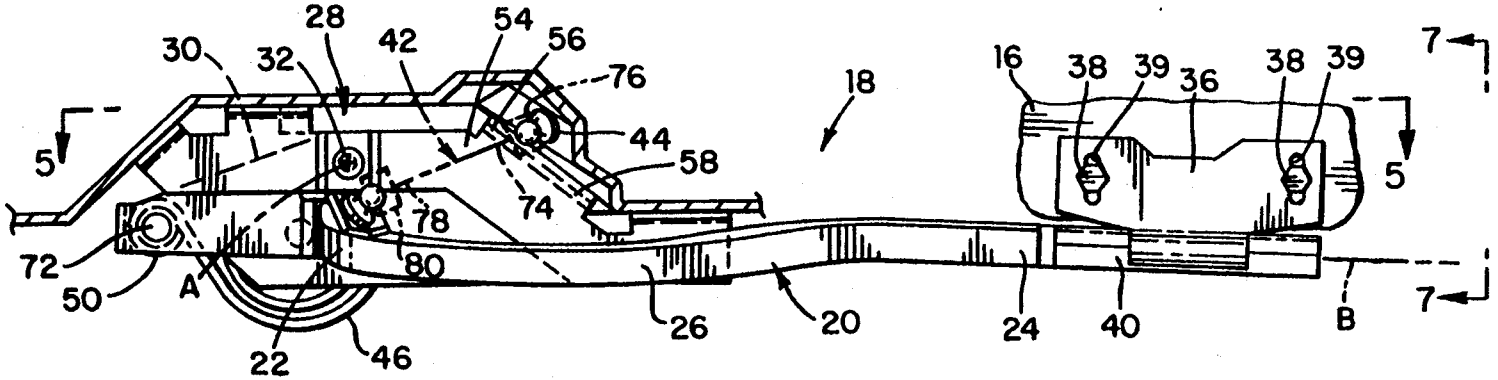
FIG. 3 is a side elevational view of the gooseneck hinge taken in the same direction as FIG. 2 but shown in the closed position.

As illustrated best by combined reference to FIGS. 2 and 3, the gooseneck hinge 18 also includes a control link 42 that extends between the intermediate portion 26 of the gooseneck member 20 and a fixed location 44 on the vehicle body 10. As illustrated, the fixed location 44 is spaced from the hinge 18, but the hinge body member 28 could be constructed to include this fixed location where the control link 42 is connected to the vehicle body. The control link 42 swings the curved intermediate portion 26 of the gooseneck member 20 between a vertical orientation as shown in FIG. 2 with the deck lid 16 in the open position and a horizontal orientation shown in FIG. 3 with the deck lid in the closed position. Thus, in the closed position, the curved intermediate portion 26 of the gooseneck member 20 does not intrude downwardly into the associated vehicle compartment to as great an extent as do conventional gooseneck hinges since the horizontal orientation of the curved intermediate portion 26 in the closed position as opposed to the conventional vertical orientation locates this member at a higher elevation. The usable space of the compartment of the vehicle body is thus not intruded into to the extent that is conventionally the case with conventional gooseneck hinges.

Figure 6:
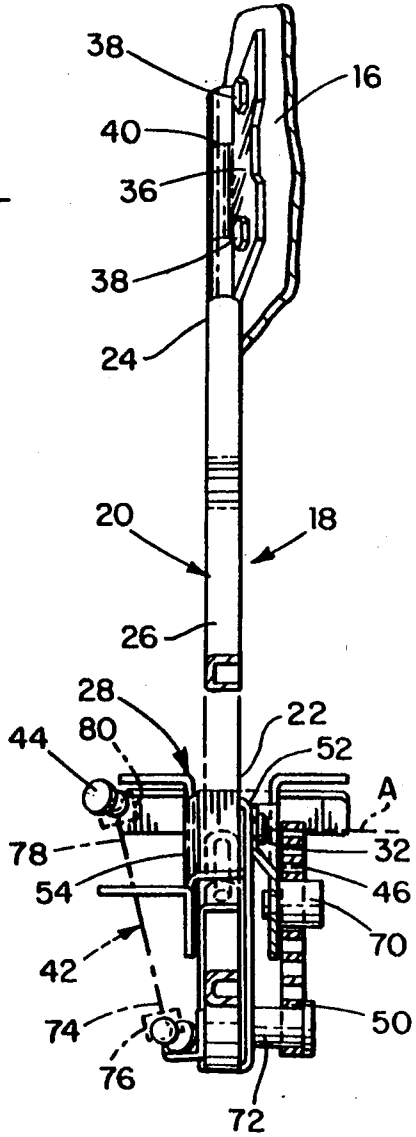
FIG. 6 is a rear elevational view of the gooseneck hinge taken along the direction of line 6—6 in FIG. 2 where the hinge is in the open position.

As best illustrated in FIG. 2, the first axis A about which the universal hinge member 30 pivots about the body member 28 is spaced from the second axis B about which the gooseneck member 20 pivots with respect to the universal hinge member as well as with respect to the deck lid 16. As best illustrated in FIGS. 2, 3 and 6, the gooseneck hinge 18 also preferably includes a counterbalance spring 46 that extends between the body member 28 and the universal hinge member 30 to counterbalance the weight of the deck lid 16 in the open position. More specifically, this spring 46 provides a counterclockwise torque to the universal hinge member 30 about the axis B so as to thereby provide the counterbalancing of the deck lid 16 supported by the gooseneck hinge member 20. Furthermore, the counterbalance spring 46 as best shown in FIG. 2 is preferably of the spiral type having an inner end 48 secured to the body member 28 and having an outer end 50 secured to the universal hinge member 30.

Figure 5:
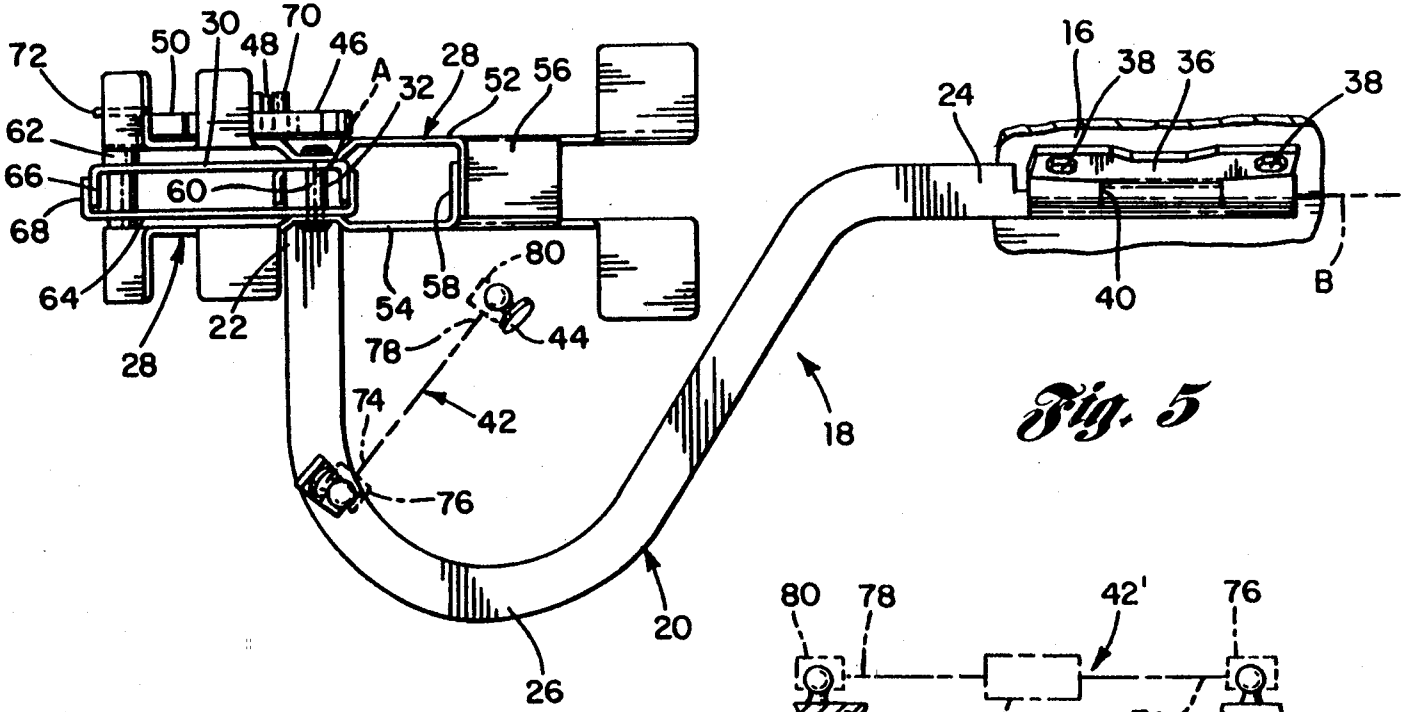
FIG. 5 is a top plan view of the gooseneck hinge taken along the direction of line 5—5 in FIG. 3 where the hinge is in the closed position.

As best illustrated in FIG. 5, the body member 28 preferably includes horizontally spaced portions 52 and 54 with overlapping flanges 56 and 58 respectively, that are secured to each other by welding with the universal hinge member 30 located between the spaced portions. More specifically, the first pivotal connection 32 has a double-headed pin 60 that provides the pivotal connection of the universal hinge member between the spaced portions 52 and 54 of the body member 28 for the pivotal movement about the first axis A. Furthermore, the universal hinge member 30 also includes a pair of spaced portions 62 and 64 which have overlapping end flanges 66 and 68 that are welded to each other.

As best illustrated in FIGS. 4–7, the spiral type counterbalance spring 46 is located on the opposite side of one of the spaced portions 52 of the body member 28 as the universal hinge member 30 that is located between the spaced portions 52 and 54 of the body member. The one spaced portion 52 as best shown in FIGS. 2 and 6 has a slotted projection 70 that extends horizontally to the counterbalance spring 46 whose inner end 48 which was previously described is secured thereto by being received within this slotted projection. The universal hinge member 30 also has a projection 72 that extends horizontally to the counterbalance spring 46 which as previously described has an outer end 50 that has a hook shape for receiving this projection so as to be secured thereto in order to provide the counterbalancing of the weight of the deck lid in the open position as previously described.

The control link 42 illustrated in FIGS. 2–7 has one end 74 including a schematically illustrated ball joint 76 for providing securement thereof to the intermediate portion 26 of the gooseneck member 20. Control link 42 also has another end 78 including a ball joint 80 for providing securement thereof to the fixed location 44 on the vehicle body.

Figure 8:
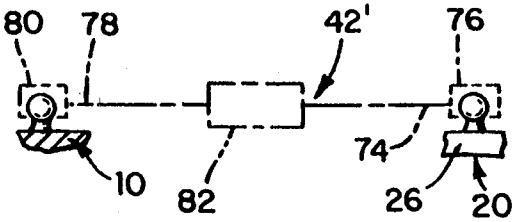
FIG. 8 is a somewhat schematic view that illustrates a modification which includes a length adjuster of a control link that swings a gooseneck member of the gooseneck hinge between vertical and horizontally extending orientations upon movement between the open and closed positions.
Figure 7:
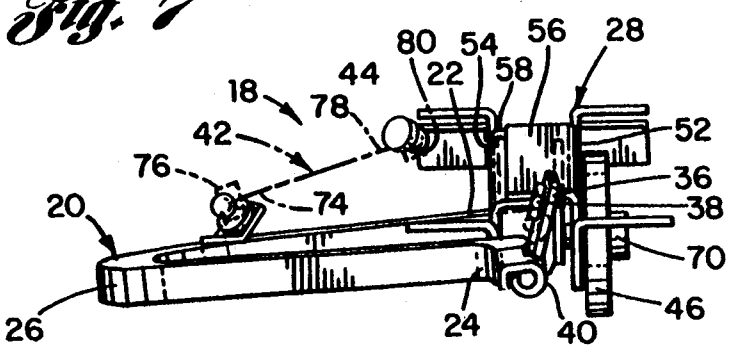
FIG. 7 is rear elevational view of the gooseneck hinge taken along the direction of the line 7—7 in FIG. 3 where the hinge is in the closed position.

With additional reference to FIG. 8, a modified embodiment of the control link 42' has the same construction as the previously described embodiment such that like reference numerals are applied to like parts thereof and much of the previous description is applicable and thus will not be repeated. However, this embodiment of the control link 42' also includes a length adjuster 82 of any suitable construction such as by threading so as to adjust the effective length between its opposite ends 74 and 78 where the ball joints 76 and 80 are respectively provided to provide the link securement. Adjustment of the length of control link 42' controls the extent to which the gooseneck member 20 swings upon movement of the deck lid between the open and closed positions.

Also, the pair of gooseneck hinges 18 shown in FIG. 1 are constructed and mounted so that the gooseneck member of each hinge extends in an inboard direction toward the other hinge in the closed position. Thus the gooseneck hinges 18 are symmetrical about the longitudinal vehicle centerline.

While the best modes for carrying out the invention have been described in detail, those familiar with the art to which this invention relates will recognize various alternative designs and embodiments for carrying out the invention as described by the following claims.

What is claimed is:

1. A gooseneck hinge for mounting a deck lid on a vehicle body for movement between open and closed positions with respect to an access opening of a compartment of the vehicle body, comprising:

a gooseneck member having first and second ends and a curved intermediate portion extending between its ends;

a body member that is fixedly mountable on the vehicle body;

a universal hinge member having a first pivotal connection for mounting thereof on the body member for pivotal movement about a first axis, and the universal hinge member having a second pivotal connection that mounts the first end of the gooseneck member for pivotal movement with respect thereto about a second axis generally transverse to the first axis;

a deck lid member that is fixedly mountable on the deck lid and has a pivotal connection for mounting the second end of the gooseneck member for pivotal movement with respect thereto about the second axis; and a control link that extends between the intermediate portion of the gooseneck member and a fixed location on the vehicle body to swing the curved intermediate portion of the gooseneck member between a vertical orientation with the deck lid in the open position and a horizontal orientation with the deck lid in the closed position to thereby limit the extent to which the gooseneck member intrudes into the usable space of the compartment of the vehicle body.

2. A gooseneck hinge as in claim 1 wherein the first axis about which the universal hinge member pivots about the body member is spaced from the second axis about which the gooseneck member pivots with respect to the universal hinge member and the deck lid.

3. A gooseneck hinge as in claim 1 further including a counterbalance spring that extends between the body member and the universal hinge member to counterbalance the weight of the deck lid in the open position.

4. A gooseneck hinge as in claim 3 wherein the counterbalance spring is of the spiral type having an inner end secured to the body member and an outer end secured to the universal hinge member.

5. A gooseneck hinge as in claim 1 wherein the body member includes horizontally spaced portions between which the first pivotal connection of the universal hinge member provides mounting thereof on the body member for the pivotal movement about the first axis.

6. A gooseneck hinge as in claim 5 wherein the universal hinge member has a pair of spaced portions secured to each other.

7. A gooseneck hinge as in claim 5 further including a spiral type counterbalance spring that is located on the opposite side of one of the spaced portions of the body member as the universal hinge member that is located between the spaced portions of the body member, said one spaced portion of the body member having a first projection that extends horizontally to the counterbalance spring which has an inner end secured thereto, and the universal hinge member having a second projection that extends horizontally to the counterbalance spring which also has an outer end secured thereto so as to counterbalance the weight of the deck lid in the open position.

8. A gooseneck hinge as in claim 1 wherein the control link has one end including a ball joint for providing securement thereof to the intermediate portion of the gooseneck member and also has another end including a ball joint for providing securement thereof to the fixed location on the vehicle body.

9. A gooseneck hinge as in claim 1 wherein the control link includes a length adjuster to control the extent to which the gooseneck member swings upon movement of the deck lid between the open and closed positions.

10. A gooseneck hinge as in claim 1 wherein the control link has one end including a ball joint for providing connection thereof to the intermediate portion of the gooseneck member and another end including another ball joint for providing securement thereof to the fixed location on the vehicle body, and the control link including a length adjuster for controlling the extent to which the gooseneck member swings upon movement of the deck lid between the open and closed positions.

11. A gooseneck hinge for mounting a deck lid on a vehicle body for movement between open and closed positions with respect to an access opening of a compartment of the vehicle body, comprising:

a gooseneck member having first and second ends and a curved intermediate portion extending between its ends;

a body member that is fixedly mountable on the vehicle body;

a universal hinge member having a first pivotal connection for mounting thereof on the body member for pivotal movement about a first axis, and the universal hinge member having a second pivotal connection that mounts the first end of the gooseneck member for pivotal movement with respect thereto about a second axis generally transverse to the first axis;

a deck lid member that is fixedly mountable on the deck lid and has a pivotal connection for mounting the second end of the gooseneck member for pivotal movement with respect thereto about the second axis;

a control link that extends between the intermediate portion of the gooseneck member and a fixed location on the vehicle body to swing the curved intermediate portion of the gooseneck member between a vertical orientation with the deck lid in the open position and a horizontal orientation with the deck lid in the closed position to thereby limit the extent to which the gooseneck member intrudes into the usable space of the compartment of the vehicle body; and a spiral type counterbalance spring that extends between the body member and the universal hinge member to counterbalance the weight of the deck lid in the open position.

12. A gooseneck hinge for mounting a deck lid on a vehicle body for movement between open and closed positions with respect to an access opening of a compartment of the vehicle body, comprising:

a gooseneck member having first and second ends and a curved intermediate portion extending between its ends;

a body member that is fixedly mountable on the vehicle body and includes a pair of spaced portions;

a universal hinge member having a first pivotal connection for mounting thereof between the spaced portions of the body member for pivotal movement about a first axis, and the universal hinge member having a second pivotal connection that mounts the first end of the gooseneck member for pivotal movement with respect thereto about a second axis generally transverse to the first axis;

a deck lid member that is fixedly mountable on the deck lid and has a pivotal connection for mounting the second end of the gooseneck member for pivotal movement with respect thereto about the second axis;

a control link having one end including a ball joint connected to the intermediate portion of the gooseneck member and having another end including another ball joint connected to a fixed location on the vehicle body to swing the curved intermediate portion of the gooseneck member between a vertical orientation with the deck lid in the open position and a horizontal orientation with the deck lid in the closed position to thereby limit the extent to which the gooseneck member intrudes into the usable space of the compartment of the vehicle body; and a spiral type counterbalance spring that extends between the body member and the universal hinge member to counterbalance the weight of the deck lid in the open position.

* * * * *